United States Patent [19]

Cusi

[11] 4,273,035

[45] Jun. 16, 1981

[54] METHOD AND APPARATUS FOR STABILIZING OPERATION OF A PRESS

[76] Inventor: Dante S. Cusi, Benjamin Franklin 132, Mexico City 18, Mexico

[21] Appl. No.: 971,307

[22] Filed: Dec. 20, 1978

Related U.S. Application Data

[63] Continuation-in-part of Ser. No. 937,755, Aug. 29, 1978, abandoned.

[51] Int. Cl.[3] ..... B30B 9/12

[52] U.S. Cl. ..... 100/37; 100/49; 100/99; 100/117; 100/127; 100/158 C

[58] Field of Search ..... 100/43, 99, 117, 37, 100/48, 49, 50, 158 C, 126, 127

[56] References Cited

U.S. PATENT DOCUMENTS

| | | | |
|---|---|---|---|
| 2,249,736 | 7/1941 | Anderson | 100/43 |
| 2,340,009 | 1/1944 | Meakin | 100/43 |
| 2,817,287 | 12/1957 | Onarheim | 100/50 |
| 3,143,956 | 8/1964 | Hurtig | 100/43 |
| 3,276,353 | 10/1966 | Burner | 100/37 |
| 3,518,936 | 7/1970 | Bredeson | 100/117 |

FOREIGN PATENT DOCUMENTS

| | | | |
|---|---|---|---|
| 561680 | 6/1977 | U.S.S.R. | 100/37 |

*Primary Examiner*—Billy J. Wilhite

*Attorney, Agent, or Firm*—Davis, Hoxie, Faithfull & Hapgood

[57] ABSTRACT

A method and apparatus for stabilizing the operation of a dewatering press operating on a known liquid-solid mixture by measuring a physical property such as the pressure of the material being dewatered at an intermediate position in the press, comparing the measured value with a predetermined optimum value set at will by the machine operator, and generating from the comparison a process alteration capable of stabilizing the operation of the press.

40 Claims, 13 Drawing Figures

METHOD AND APPARATUS FOR STABILIZING OPERATION OF A PRESS

This application is a continuation-in-part of application Ser. No. 937,755 filed Aug. 29, 1978, now abandoned.

SUMMARY OF THE INVENTION

The present invention relates to a method and apparatus for stabilizing and controlling the operation of a press used to separate the solid phase of a liquid-solid mixture from the liquid phase thereof by pressing the mixture against a rigid barrier provided with perforations so that the liquid flows through the perforations to the outside of the press while the solids remain inside the press.

The invention involves measuring the value of a physical property of the mixture at a particular position within the press, comparing the measured value of that property with a set of predetermined values, and determining from the result of that comparison a process alteration capable of stabilizing or controlling the operation of the press.

BACKGROUND OF THE INVENTION

The invention deals with the practical operation of separating liquids from solids by pressing. This operation has many industrial applications including the separation of fibers or solid materials from water or liquids of any kind in the sugar industry, in pulp and paper manufacturing, in chemical manufacturing and in other fields.

For example, in the processing of wood or any other lignocellulosic material for the production of pulp and paper, the raw material is subject to a series of treatments in water suspension or with chemical solutions at relatively low solid-to-liquid ratios or consistencies that require subsequent dewatering steps.

In applications where only slight dewatering and consistency increases are desired, vacuum or pressurized screens or filters are commonly used. In applications where higher consistencies must be reached, as in feeding pressure vessels, digesters or chemical reactors, presses of many designs have been built and operated. These may be classified in the following three main categories:

(1) Roll presses in which the material is pressed between two rolls, perforated or not, such as in paper making, sugar cane crushing and others.

(2) Disk (or cone) presses in which the material is pressed between two perforated disks (or cones) rotating around their respective axes that are set at an angle relative to each other.

(3) Screw presses in which the material is pressed by a specifically designed screw rotating inside a cylindrical or conical perforated barrel.

Presses are particularly useful when substantial dewatering is desired because of the high consistencies they can provide as compared to other dewatering devices. This becomes particularly important as a water and energy saving factor in vapor phase cooking systems, in high consistency washing and bleaching procedures and in other operations. However, despite these obvious advantages, presses are not generally used as effectively as they could be for several reasons, among which are the following:

Roll presses are expensive and quite delicate in their operation since hard foreign bodies, even if small, may damage the roll surfaces, especially if the latter are of the perforated type.

Disk presses are expensive, have small drainage surface and feed ports requiring pre-dewatered material, and the sealing of moving parts against the casing of the machine is difficult and generally inefficient.

Commercially available screw presses, though generally less expensive and of simpler design than other types, are unstable in their operation and difficult to control.

The shortcomings of prior art screw press operation can be explained as follows.

Most materials subjected to dewatering by pressing require increasing pressure increments for every equal increment of liquid removal. For this reason, the pressure follows an exponential curve relative to the volume reduction curve. This relationship means that at the last stages of the compression, corresponding to the higher pressures, a small difference in the compression ratio or a small excess in the material feed rate to a screw press having a fixed configuration may cause a sudden and substantial increment of the pressure that may "jam" the machine, meaning that the material being pressed may become very hard because of excessive dewatering. Consequently, the power needed to drive the machine may exceed that available, or the pressure may reach a level that may damage the machine itself. When a "jam" occurs the press must be stopped and any over-compressed material must be freed before the press can resume operation. On the other hand, if the feed rate or the consistency of the feed slurry momentarily decreases below the designed value, even by a small margin, the press may "slip" meaning that no compression results from the rotation of the screw element because the material in the press rotates with the screw.

The proper operation of such a press requires, therefore, a gradual increase of pressure from the inlet to the outlet. Such a condition is unstable, because a pressure increase at any point, due to any variation of the slurry feed rate or consistency, tends to increase the dewatering, and this, in turn, results in increased friction which generates still further pressure increases. Conversely, a decrease of pressure, resulting from an opposite event, tends to decrease the dewatering, and that generates a further decrease of the internal friction and of the pressure-generating capability of the machine. In the former event the machine will tend to jam and in the latter, to slip.

It is apparent that presently available screw presses are characterized by an unstable operation since any deviations from stable operating conditions tend to become larger rather than be corrected by the natural dynamics of the machine operation. By contrast, the present invention provides a means for stabilizing the operation of screw presses at a desired level of performance, in a manner such that deviations from optimum operating conditions are readily corrected.

DETAILED DESCRIPTION

Certain relationships are usefully employed in connection with a detailed discussion of the present invention. Consistency, expressed in percentages, is the weight ratio of dry solids in a liquid-solid mixture to the total weight of the mixture. Overall volume reduction ratio is the ratio of the volume of the pressed material passing the press outlet per unit time to the volume of material to be pressed passing the press inlet per unit time. Compression ratio is the ratio of the pressure generated by the press mechanism at the outlet relative to the pressure at the inlet. This ratio is a composite function of the volume reduction ratio, the properties of the material being pressed, the initial consistency of the material entering the press, the time during which the pressing action is sustained, and other factors.

Figure 1:
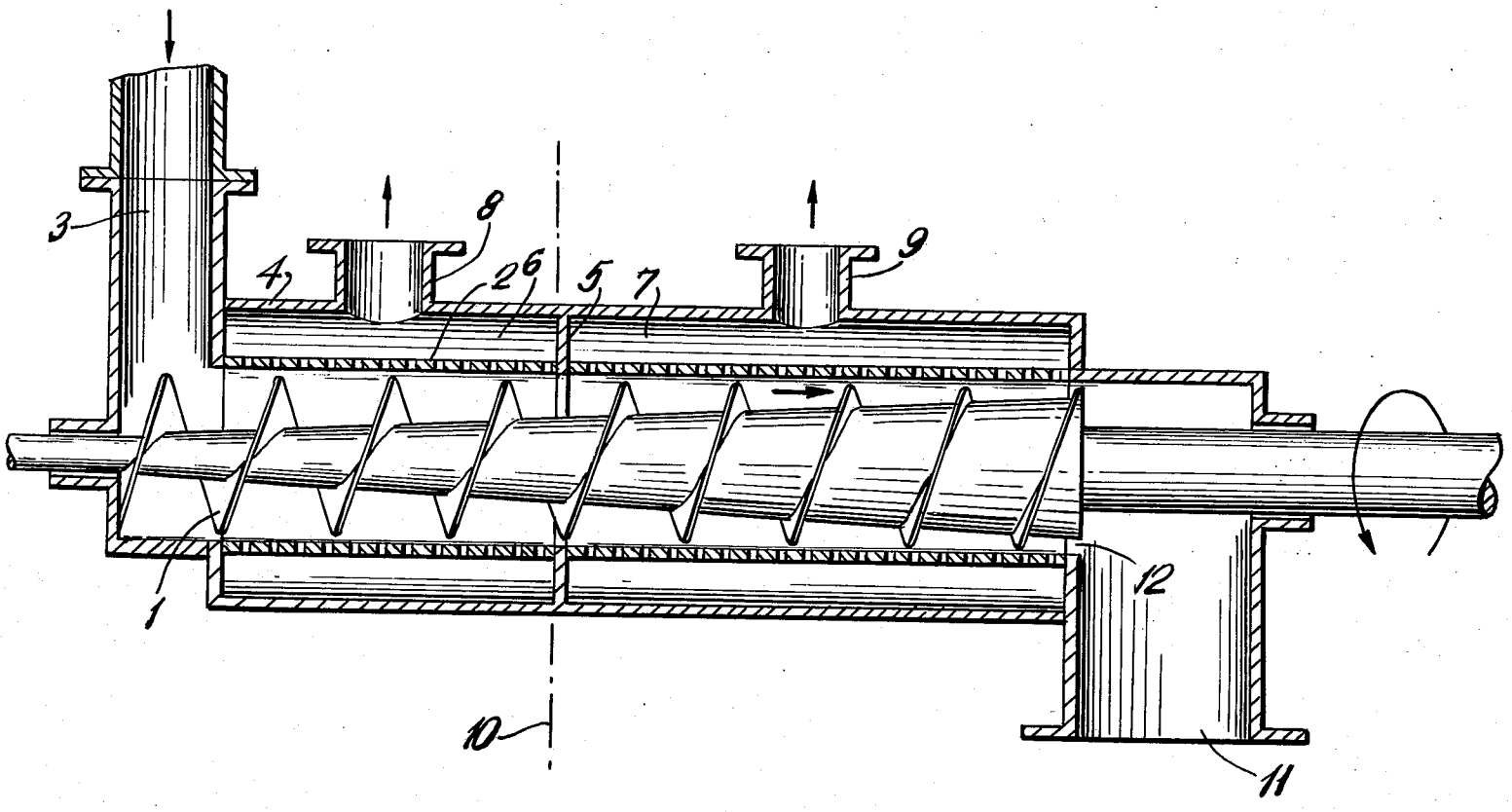
FIG. 1 is an elevational view in section of a screw press suitable for use in the present invention.

A press that can be used to illustrate the method of the present invention is shown in FIG. 1. The press includes screw 1, located inside stationary, perforated cylindrical barrel 2 and supported by bearings, not shown. The screw is designed to have a conical hub and a thread having a cylindrical outside profile of a diameter only slightly less than the inner diameter of barrel 2, as is customary in well designed screw presses. The design of the screw is such that the space between the screw hub and thread and the inner wall surface of barrel 2 is a helicoidal channel extending from the inlet to the outlet of the press, the volume of the channel per turn decreasing gradually from inlet to outlet because of the increasing diameter of the screw hub. The press is provided with an inlet opening 3 through which the material to be pressed is pumped or otherwise introduced under suitable pressure. While the monitoring and controlling of the operation of the inlet system are a part of the present invention, the details of construction of the components of the inlet system are not part of the present invention. A cylindrical shell 4 completely surrounds barrel 2 throughout at least the first portion of its length. Perforated barrier 2 and cylindrical shell 4 may each be built either in one piece or in modular form. In this latter case the press can be constituted by a plurality of draining and shell modules stacked one on top of the other and retained together, to form the body of the press, by suitable ties or bars.

Annular partition 5, connected around its outer edge to shell 4 and around its inner edge to barrel 2, divides into two compartments 6 and 7 the chamber between barrel 2 and shell 4, each compartment being provided with an opening, 8 and 9 respectively, for the outflow of the expressed liquids issuing into either compartment through perforated barrel 2. The cross section perpendicular to the direction of flow through the press at which partition 5 is placed is the control cross section 10. As will be more fully explained below, the material's consistency at control cross section 10, coincident with the location of partition 5, will depend on its consistency and flow rate at inlet 3 as well as on the outflow of expressed liquid from opening 8. Consequently, by controlling the outflow of expressed liquid from opening 8, as by an adjustable valve, not shown in this Figure, while maintaining constant the consistency at inlet 3, it is possible to stabilize the consistency at 10.

As the material moves downstream from control section 10, it will be further compressed by the action of the screw, as explained, and the liquid expressed out will leave through opening 9, while the fully compressed material will finally exit from the press at 11.

A general description of the present invention based on the press shown in FIG. 1 can now be given. For purposes of this discussion, specific reference will be made to the pressing of a slurry of sodium hydroxide impregnated depithed bagasse fibers, used in pulp and paper making. It should be understood that the present invention is not intended to be limited to this specific application, but is intended for use in any pressing context.

By rotating inside the stationary barrel 2, the screw 1 generates a friction within the mass of the material being pressed. That portion of the material which is in contact with the barrel tends to remain stationary adjacent the barrel; on the other hand, that portion which is in contact with the screw is caused to rotate with the screw. This friction causes a net force to be exerted on the material in the forward direction, toward the downstream or outlet end of the press. The force on the material is additive, meaning that the pressure generated on the material at any point of the press by the rotation of the screw adds to the pressure generated ahead of such point until the total pressure on the material reaches its highest value at the press outlet.

Figure 4:
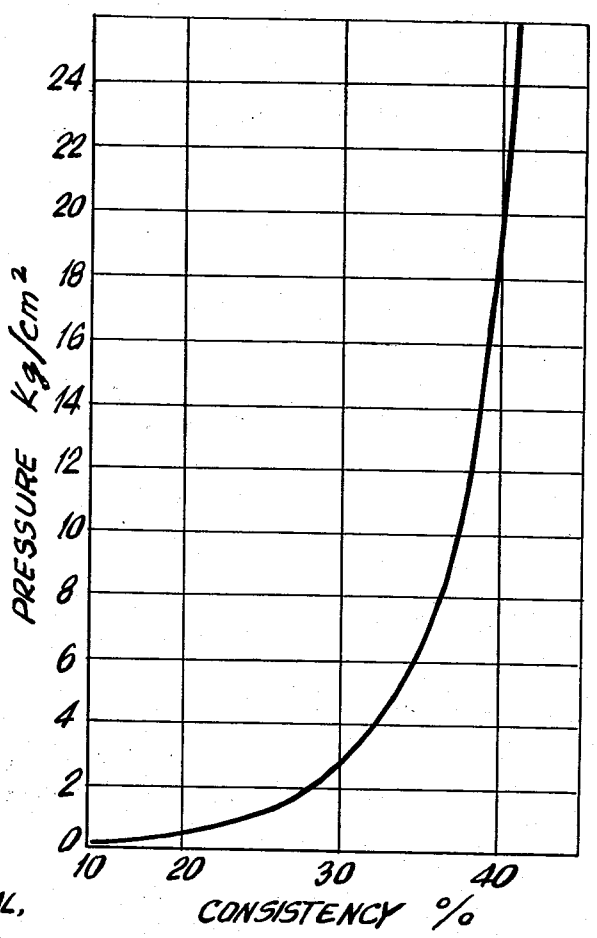
FIG. 4 is a graph based on the graphs of FIGS. 2 and 3 showing the relationship between pressure and consistency for the given material.
Figure 3:
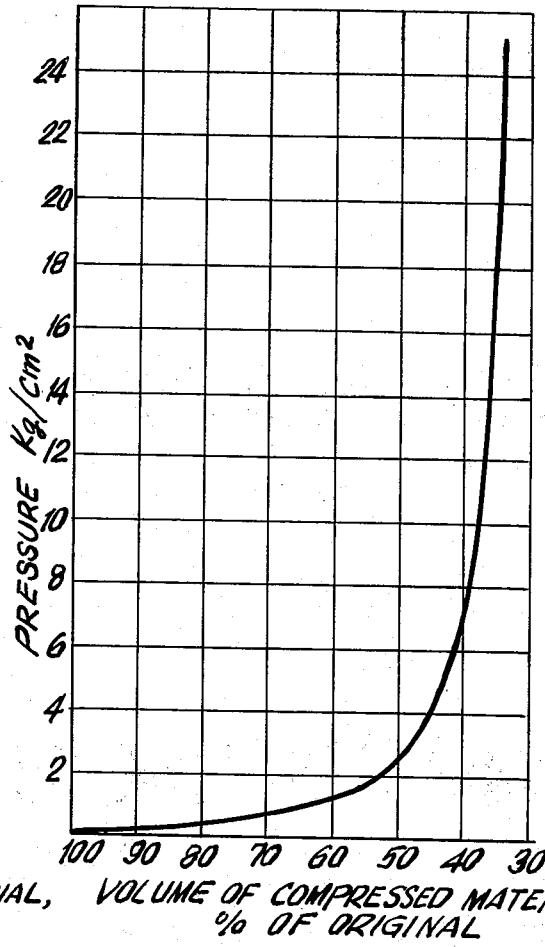
FIGS. 2 and 3 are graphs showing respectively the relationship between consistency and percent volume reduction and between pressure and percent volume reduction for a particular, but typical, material—sodium hydroxide impregnated depithed bagasse fiber.
Figure 2:
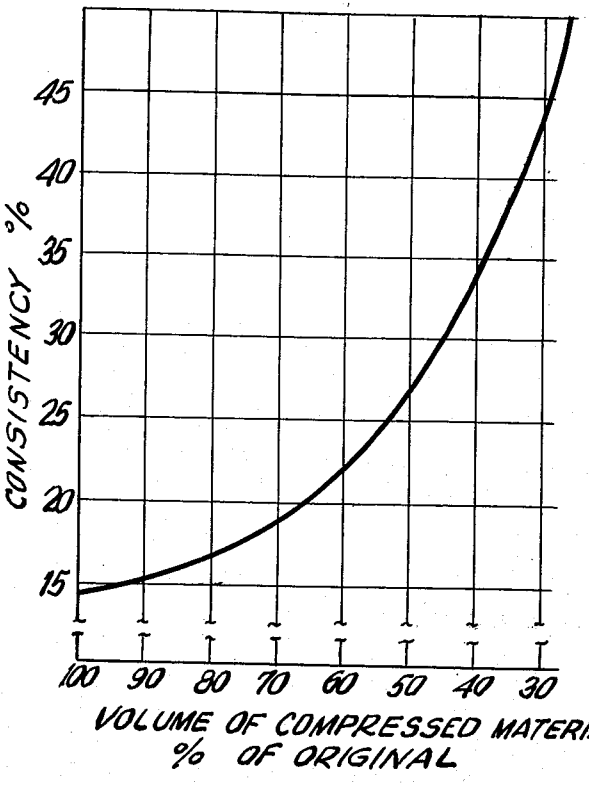

In a continuous pressing operation, for a given press geometry and speed of screw rotation and a given feed material, feed rate and feed pressure, there are direct, reproducible relationships between pressure and consistency of the material being processed on the one hand, and between pressure and percent volume reduction on the other. An exemplary set of these relationships, for a particular press and the described sodium hydroxide impregnated depithed bagasse material, is shown in FIGS. 2 and 3. These curves, derived by experiment, are easily reproducible under constant process conditions. FIG. 4, derived from FIGS. 2 and 3, shows directly the interdependence of pressure and consistency.

Figure 5:
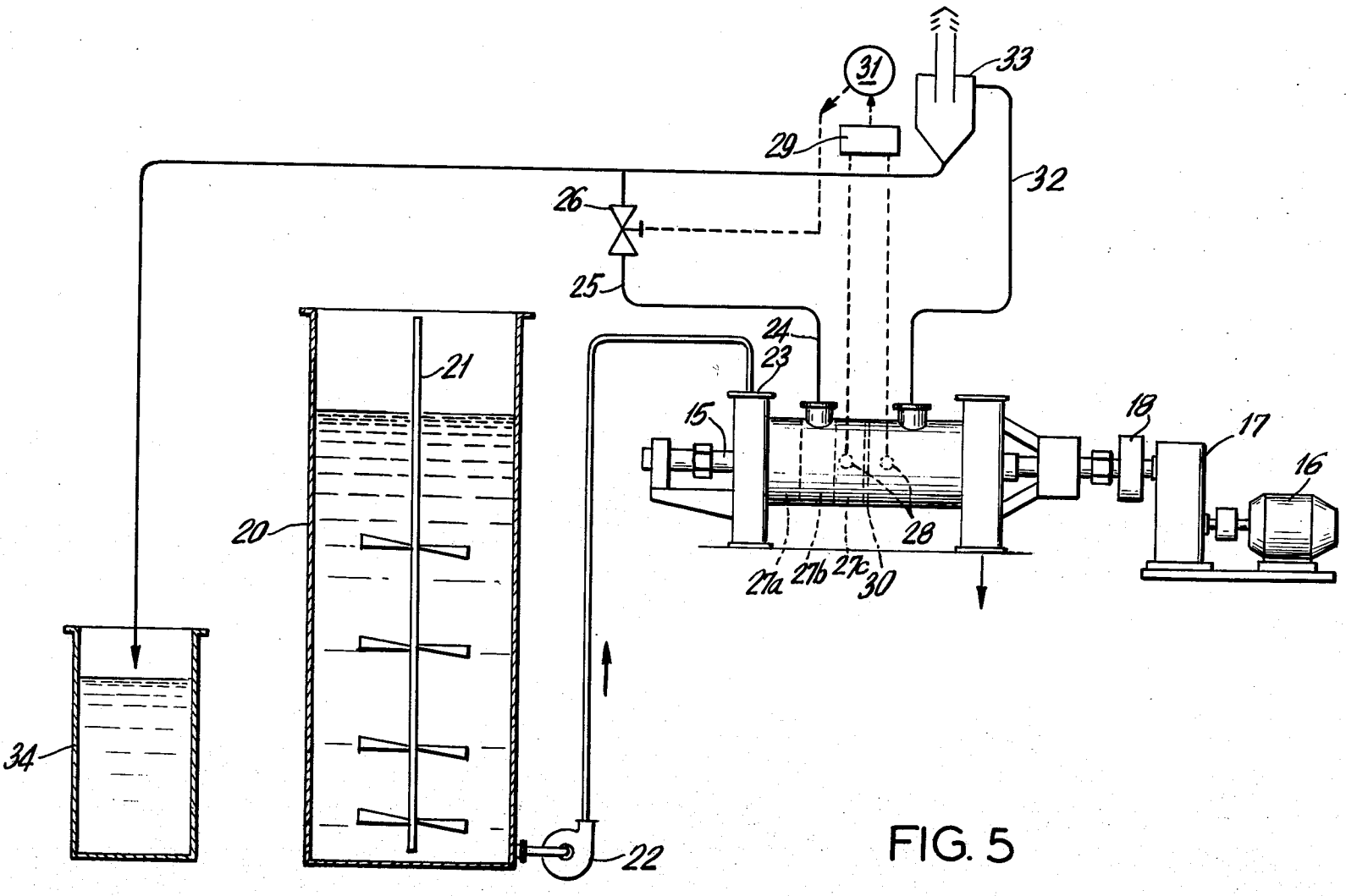
FIG. 5 is a schematic elevational view, partly in section, of a first embodiment of the present invention.

As is apparent from an examination of these curves, under steady operating conditions, the consistency of the material at any point in the press is a function of its pressure at that point. Hence pressure can be taken as a basis for measuring consistency and the dewatering stage reached by the press, or the other way around. Further, by varying the amount of restriction of the flow through opening 8 and hence the volume rate at which liquid can leave compartment 6, the differential pressure across perforated barrel 2 at and upstream of control cross section 10 can be altered, and thereby so can the consistency of the material being pressed. A system according to the present invention designed to operate in this manner is shown in FIG. 5.

The slurry to be dewatered is introduced into feed tank 20. This tank is equipped with mixer 21 which prevents the settling or flotation of particles and equalizes the consistency of the slurry. Pump 22 transfers the slurry to inlet port 23 of the press at a pressure sufficiently high to overcome frictional losses in the liquid expressing system (opening 24, pipe 25 and valve 26) and to provide adequate positive pressure within the press to permit the consistency of the material to rise to the point at which screw action can commence. It should be understood that initial draining of the slurry in the upstream portion of the press under the pressure generated by pump 22 causes the material to reach a consistency at which the action of the screw can begin to further increase the consistency. A material having insufficient consistency will slip as the screw turns rather than be moved by it. This condition of sufficient consistency must be reached upstream of control section 30. Shaft 15 of the press is driven by the motor 16, through reduction gear 17 and coupling 18. Suitable switchgear, starter and speed control equipment is intended but not shown since it is conventional and well understood by persons skilled in the art.

Drainage modules 27*a, b* and *c* form the low pressure or upstream part of the press. Liquids expressed in these modules flow through opening 24, pipe 25 and adjustable valve 26. Instruments 28 are internal pressure measurement devices installed on either or both sides of control section 30. They may conveniently comprise strain gages mounted in such a manner as to accurately measure the internal pressure, that is, the pressure of the material being pressed. Generally a single gage is sufficient, but a plurality may also be employed using a switch shown at 29 to choose any of the signals or a suitable average, as desired.

In operation, instruments 28 transmit their indications of pressure to switch 29 and then to controller 31 which in turn controls the setting of valve 26. Controller 31, the precise nature of which is not part of the present invention, is programmed in accordance with the information displayed in FIG. 4 so as to maintain the pressure at control cross section 30 at a predetermined desired value. A pressure decrease sensed by instruments 28 indicates a drop in consistency which in turn requires that valve 26 must be opened to allow a larger outflow of liquid. Conversely, a rise in pressure at control cross section 30, indicating an increase in consistency at that point, can be used to decrease the outflow of expressed liquid, raise the pressure in the chamber surrounding the barrel, and thereby decrease the amount of liquid expressed.

Liquids expressed downstream from control cross section 30 leave the press through pipe 32. In cases where the press is used as a feeder for a pressurized heated vessel such as a pulping digester, cyclone 33 may be usefully inserted in pipe 32 to separate from the liquid flow any gas or vapor that may have escaped backwards from the vessel and to recover liquids that then flow into tank 34 for recirculation or other use.

Figure 6:
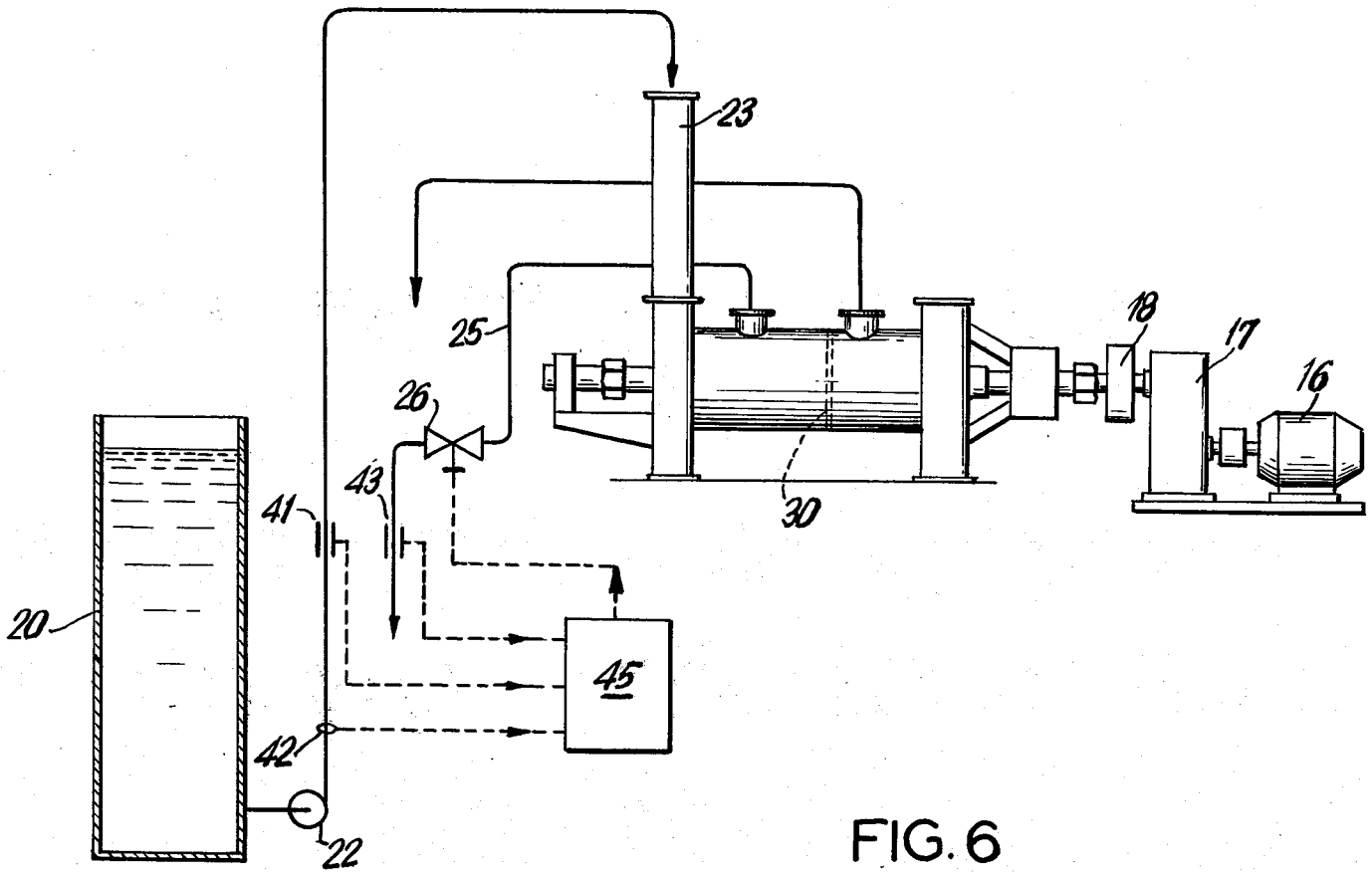
FIG. 6 is a schematic elevational view, partly in section, of a second embodiment of the present invention.

If desired, a number of alternate control modes based on the disclosed relationship can be selected for use in a given press. A particularly useful control mode is illustrated in the embodiment of FIG. 6. This mode, it will be seen, employs exclusively flow generated control signals; moreover, this embodiment requires no instrumentation whatever to be attached to the press itself. In this embodiment, in which elements also appearing in FIG. 5 are similarly numbered, a central control unit 45 receives signals from flow volume meter 41 and flow consistency sensor 42, operatively associated with the conduit connecting pump 22 with press input 23. These two signals, suitably combined, indicate the amount of solid material passing into the press per unit time. Control unit 45 also receives a signal from flow volume meter 43 which is associated with the conduit 25 carrying the liquid expressed from the press upstream from cross section 30. Flow meter 43 may be located downstream, in the liquid flow sense, from valve 26.

Given those three pieces of information, together with the information contained in the graphs of FIGS. 2–4, control unit 45 calculates the consistency of the material being processed at cross section 30 and appropriately controls the operation of valve 26 to maintain that consistency at the desired value.

If the consistency of the feed material is somehow regulated, consistency sensor 42 would be unnecessary. Control unit 45 would then operate to control valve 26 to maintain a certain desired ratio, derived from the information contained in the graphs of FIGS. 2–4, between the flow volumes measured by flow meters 41 and 43. Conversely, if the feed flow rate were regulated, the feed consistency could be monitored by sensor 42 and that measurement, combined with the measurement from flow meter 43, would permit control unit 45 to suitably control valve 26 to stabilize operation of the press. If desired, the signals from flow meter 41 and consistency sensor 42 can be suitably combined and integrated with respect to time by logic circuitry known to the art to monitor the total amount of material treated by the press as of a given time. Also, if desired, the indication of the amount of material fed to the press can be correlated to the values calculated from the pressure measurements taken by instruments 28 to permit calibration of the press as a measuring instrument. This will also allow calculation of the slippage, which increases with wear of internal parts, and consequently will aid in scheduling press maintenance.

It is essential to the practice of the embodiment just described that no significant amount of solids are expressed with the liquid. Otherwise, a consistency meter would be required in the passage for the expressed matter, or some other adjustment would have to be made to account for the less-than-ideal amount of solids present in the press.

The invention disclosed has industrial application in press operations used to extract liquid-solid mixtures from a pressurized vessel. The extraction of materials from a pressure vessel using a high temperature treatment is today generally performed by a "blow", i.e., by discharging the material under the pressure of the vessel through an orifice. Using such a system, the treated material may be damaged by a rapid expansion of vapor and gases if the pressure is suddenly released without a previous decrease in the temperature. To prevent such damage, in today's practice, liquids at a temperature lower than the treated material are pumped to the inside of the pressure vessel (digester) at a point upstream of the "blow valve". Such an operation (cold blow) is expensive, requiring substantial amounts of energy.

Figure 7:
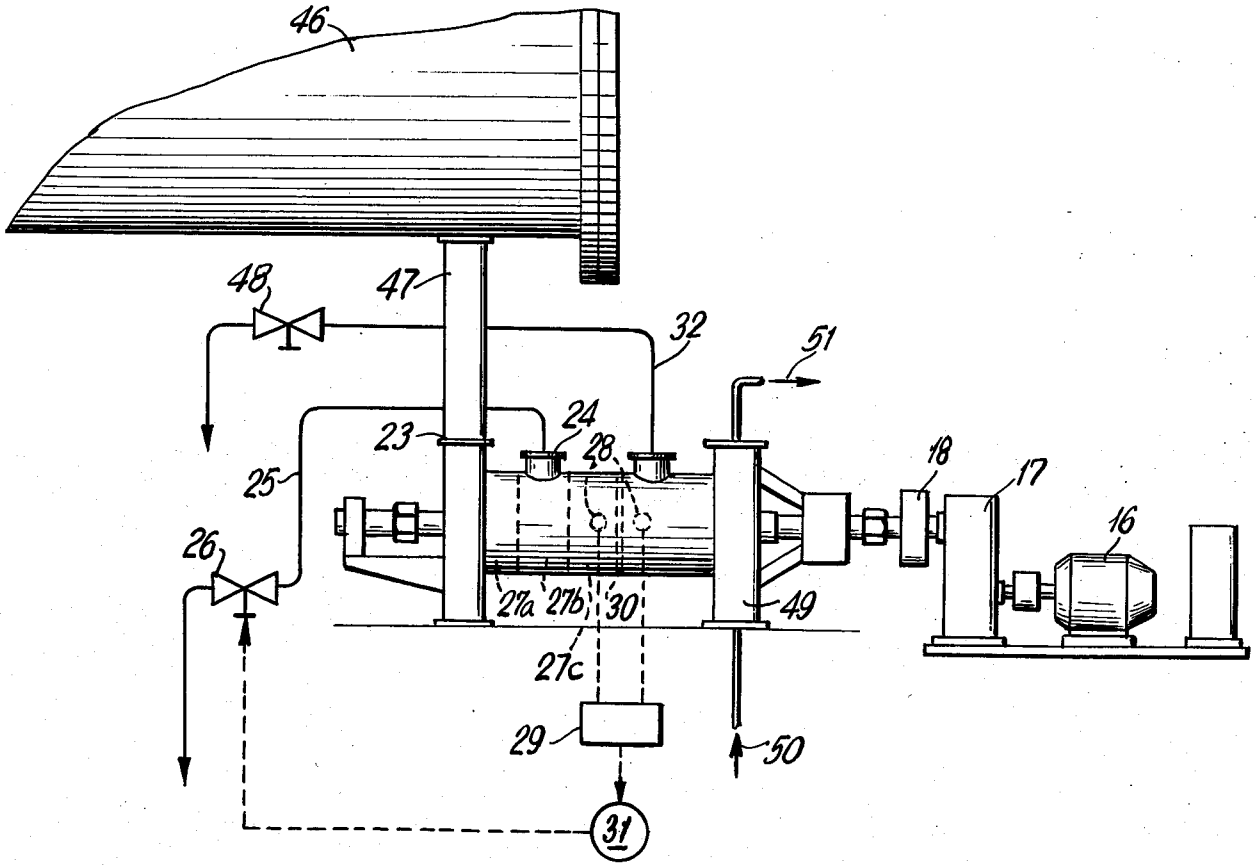
FIG. 7 is a schematic view of an embodiment in which the press of the present invention is used to extract material from a pressure vessel.

The invention disclosed can perform the extraction without this pressure drop problem by maintaining a stable and controlled pressure differential throughout the press. Such an embodiment is shown in FIG. 7. This press extraction system shown incorporates the embodiment of the invention as shown in FIG. 5 as the output device connected to a continuous digester 46. Strain gauges 28 measure the internal pressure on either or both sides of control section 30; instruments 28 transmit their indications of pressure to switch 29, and then to controller 31 which in turn controls the setting of valve 26.

In FIG. 7, the continuous digester 46 discharges into chute 47. The material falls by gravity to inlet port of the press 23. The liquors draining from the modules 27*a*, *b* and *c*, upstream of control section 30, flow through opening 24, pipe 25 and valve 26. The liquors draining from the modules located downstream of control section 30 leave the press through pipe 32 and valve 48. To carry the pressed material to the next operation, water or "black liquor" can be injected into the discharge module 49 at 50 to carry away the material through 51.

By maintaining a controlled and stabilized pressure differential of a relatively small amount through the section of the press upstream of the control section, this embodiment of the invention will minimize the possibility of the flash generation of steam and minimize any drop in temperature. This permits the extraction of a substantial proportion of the residual liquors left in the material from its passage through digester 46 at a high temperature. The liquors extracted through pipe 32 can also be kept at a high pressure by controlling valve 48 through standard pressure control instrumentation. There is no problem of flash steam generation or of a sudden pressure drop in the section of the press downstream from the control section because the liquor pressure within these modules has been raised in the upstream portion of the press and can be kept at a higher level.

The hot liquors emerging from valves 26 and 48 can be used to heat the incoming liquid at 50 or for any other convenient purpose. This press then performs the double functions of controlling the extraction of the material from a pressure vessel and of removing a substantial portion of the liquid at high temperatures, equivalent to accomplishing the first stage of a washing sequence. The control systems previously detailed can also be applied to the embodiment shown in FIG. 7.

Figure 8:
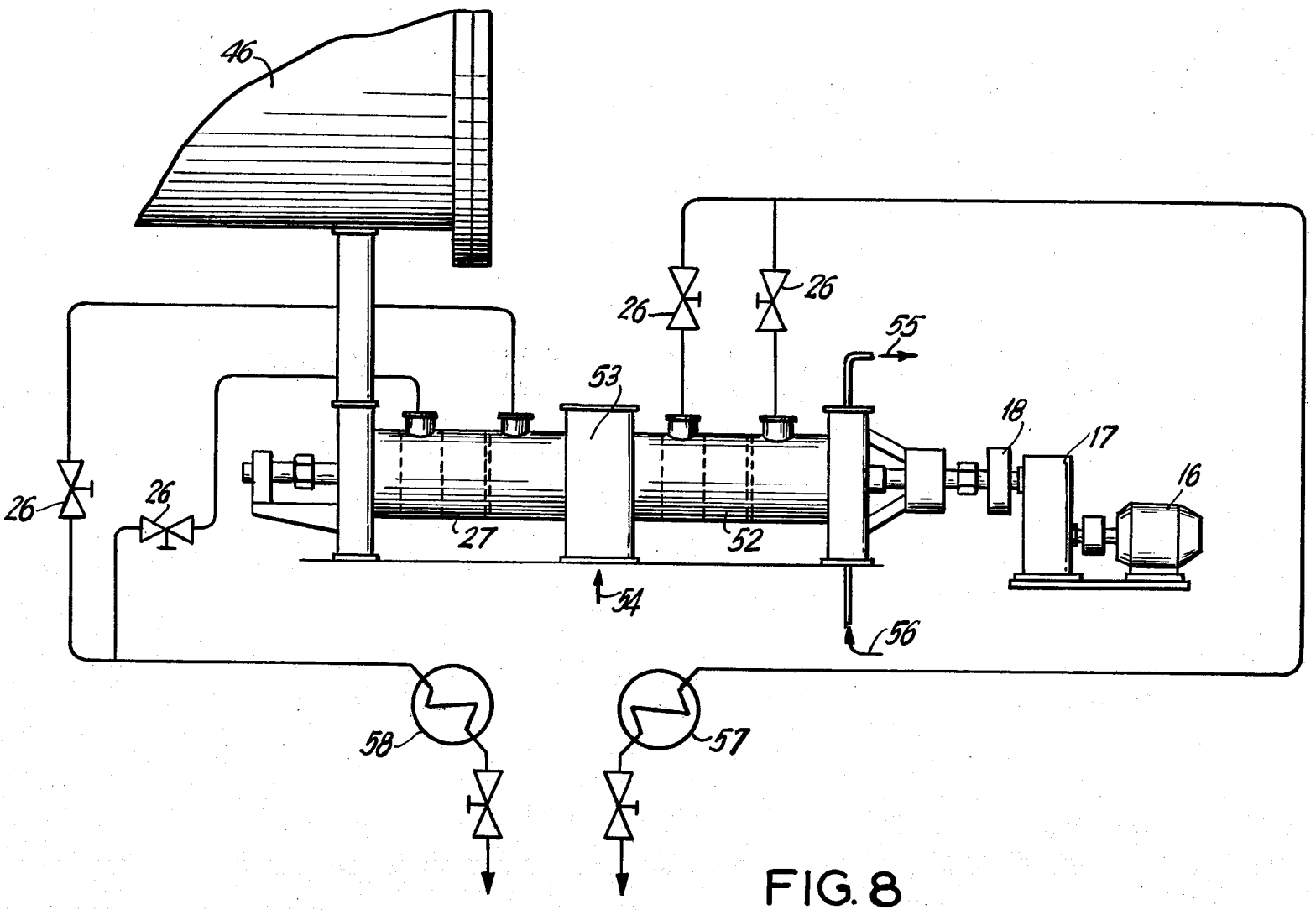
FIG. 8 is a schematic view of an embodiment of the present invention involving multistage pressing.

The precise control of the press operation by the principle and means herein described further allows for the coupling of presses on a single shaft without danger of slipping or jamming, thus decreasing the cost of installation of multi-stage press systems. This feature can be applied to a two-stage washing operation as illustrated in FIG. 8 in which the extractor press 27 is equivalent to the press shown in FIG. 7, and press 52 is the second stage washing press.

The material from the first press stage is discharged into mixing chamber 53 where it is washed by liquid injected at 54, and then fed into the second press stage. At discharge from the second press 52 the material can either be discharged from the system or carried to the next operation 55 by injecting a suitable liquid at 56. Heat exchangers 57 and 58 can be used to recover the heat from the outgoing high temperature liquors. The instrumentation for controlling each stage of this multi-stage press system can either be a pressure generated control signal, as in FIG. 5, or a flow generated control signal, as in FIG. 6. These signals can then be used to control valves 26 to maintain the optimum pressure at the points.

The amount of heat recovery and the pressures throughout this multi-stage system are dependent upon the type of operation and other factors well known to experts in the art, and can be designed for optimum efficiency and economy.

Figure 9:
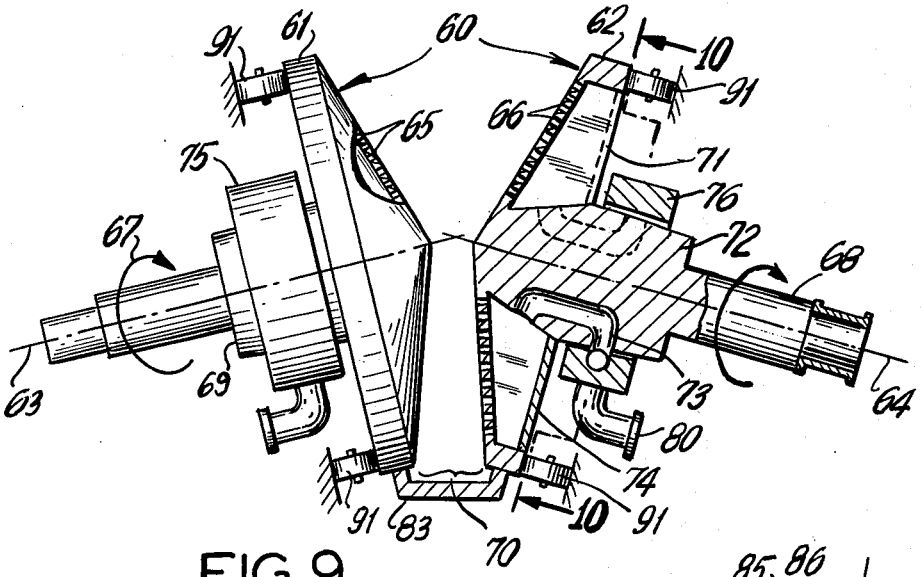
FIG. 9 is a side elevational view in partial section of a disk press suitable for use in practicing the present invention.
Figure 10:
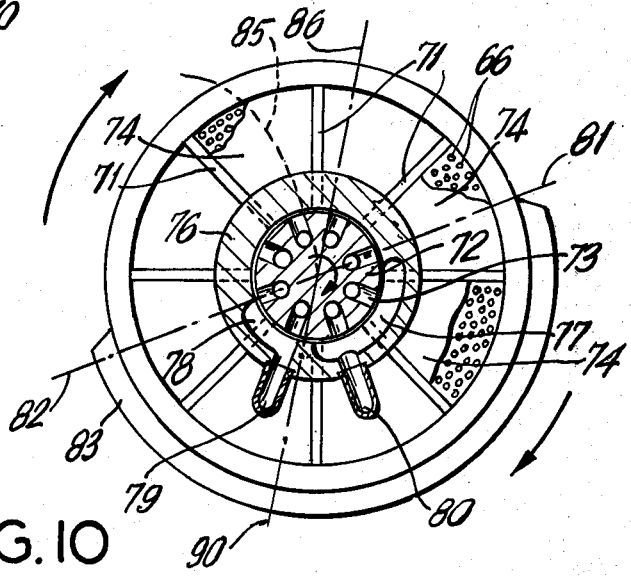
FIG. 10 is a rear elevational view, partly in section, of one of the disks of the press shown in FIG. 9, taken along the line 10—10 in FIG. 9.

The invention disclosed is applicable to presses of other than the screw type. For example, FIGS. 9 and 10 show how it may be employed in connection with a disk press. FIG. 9 is a side view, partly in cut-away section, of a press of the type described; FIG. 10 is a rear view of the disk 62 shown in FIG. 9. The press shown comprises two conical disk 61 and 62 that revolve in the directions indicated about their respective intersecting axes 63 and 64. Axes 63 and 64 are set at some fixed angle relative to each other. Pursuant to the operating principle of a disk press, the distance between the disk faces 65 and 66 is a maximum at a first position 60 in the plane of the axes opposite the obtuse angle formed by the intersection of those axes and is a minimum at a second position 70 180° away from the first position. Therefore, material fed into the press at 60 is pressed during the disk rotation to position 70 where it is discharged. No material is processed during the second half of the disk rotation. Disk faces 65 and 66 are suitably perforated to permit the passage of liquid being expressed.

The disk faces are supported on their rear surfaces by a plurality of radially directed ribs 71 that also serve to divide the rear surface of each disk into a series of compartments. The compartments are closed by covers 74 (FIG. 10). Ribs 71 are connected to the disk axles 67 and 68 through cylindrical hubs 69 and 72, and each compartment is connected by a conduit 73 to the perimeter of the hub.

Each hub is surrounded by an annular stationary ring, shown as rings 75 and 76 in FIG. 9. Each ring has two internal chambers, shown in the case of ring 76 as chambers 77 and 78. These ring chambers are connected respectively to outlet pipes 79 and 80 (FIG. 10). The rings encircle hubs 69 and 72 and form, with those hubs, a rotary valve. Given the directions of disk rotation shown in FIGS. 9 and 10, it will be appreciated that chamber 77 will receive liquid expressed from the material as it first enters the press and chamber 78 will receive liquid expressed at locations further downstream.

The chamber between the disks is sealed by cover 83. Line 81-82 in FIG. 10 shows the plane of the axes 63 and 64; point 81 corresponds to the position 60 of greatest separation and point 82 to the position 70 of least separation.

In operation, material is fed to the press at position 81 (FIG. 10) and is continually pressed during rotation of the disks until it reaches position 82 where it is discharged. As is normal in disk presses, a fixed plow-like partition 85 located between disks 61 and 62 pushes the pressed material towards the periphery of the press for discharge and a fixed partition 86 similarly placed between the disks directs the material entering the press toward the feed position 81. Liquids drained from the press between position 81 and the position indicated on FIG. 10 as 90 flow through conduits 73 into chamber 77 and thence out of the press through outlet 80. Position 90, it will now be appreciated, is analogous in function to the control cross section disclosed above in the context of a screw press. By suitably controlling the flow from that portion of the disk press ahead or upstream of position 90, the consistency of the material leaving the press at position 82 can be controlled as described above.

Through the use of this technique, complicated hydraulic systems used in the prior art to permit relative movement of the disks to compensate for variations in the feed may be eliminated. Consequently, all bearings can be fixed, and wheels 91, used to support the disk edges against the internal pressure, can remain in a fixed position, thereby simplifying the press while retaining its primary advantage of avoiding or minimizing friction between the material being pressed and the elements of the press.

The various control embodiments discussed in the context of screw press operation above can be applied similarly to the disk press as disclosed herein.

One further control possibility should be discussed. It has been assumed throughout the preceding discussion that the drainage capacity of the press, as it may be regulated by varying the restriction on the outflow of expressed liquid, is sufficiently flexible to accomodate the liquid expressed per unit time from the material passing through the press. In other words, the discussion thus far has been based on a press design in which all the liquid that could be drained from the material at a given pressure is so drained and, conversely, that the drainage rate can be decreased by the described flow restriction sufficiently to meet any conceivable decrease in liquid volume entering the press. If any possibility exists that there is insufficient or excess drainage capacity, an additional control point should be considered—the rotation speed of the shaft.

Figure 11:
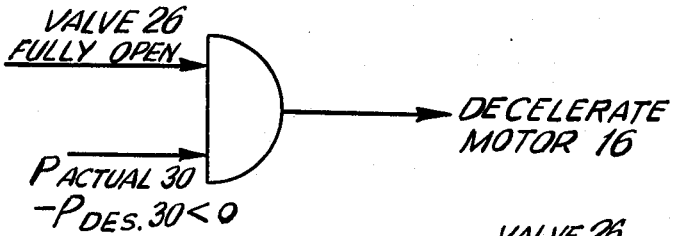
FIGS. 11 and 12 are schematic diagrams of logic circuitry for use in connection with the present invention.

According to this variation in its first aspect, discussed in connection with the embodiment shown in FIG. 5, and illustrated in part in FIG. 11, a signal from transducers 28 indicative of a decrease in the pressure of the material being pressed at control cross section 30 is processed by controller 31 according to a preset pattern into a signal causing valve 26 to open further. Under normal circumstances, that increase in liquid expressed would cause the consistency, and hence the pressure, to increase at control cross section 30. If, however, insufficient material is entering the press for some reason, this normally expected result will not occur. To deal with this contingency, a logic circuit may be employed. As shown in FIG. 11, one such possible circuit employs an AND gate with two imputs—a first signal indicating that valve 26 is fully open (maximum drainage) and a second signal indicating that the pressure measured at control cross section 30, preferably after some time lag following the full opening of valve 26, is less than the designed pressure at that point. (The second signal may alternatively indicate that the pressure of the material at cross section 30 is not increasing with respect to time even after valve 26 is fully opened.) If both inputs are present, the system emits a speed control signal causing motor 16 to slow down, decreasing the angular velocity of screw 1 and hence the volume capacity of the press.

Figure 12:
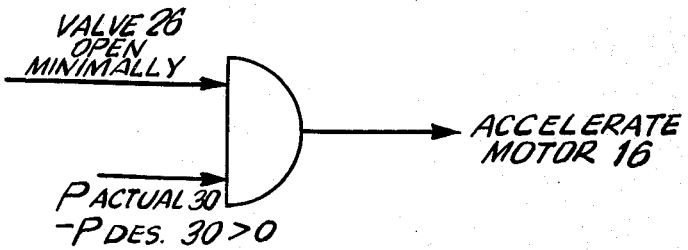

In the second case, where the pressure measured at cross section 30 remains above the design pressure even after valve 26 has been maximally constricted, circuitry such as illustrated in FIG. 12 triggers a speed control signal accelerating motor 16 and increasing the throughput capacity of the press. In effect, for a constant pressure, the press capacity is a direct function of the angular velocity of the shaft.

It will be appreciated that the concept just disclosed can be used to vary the speed of the pump 22 instead of the speed of the shaft 15.

Another use of a shaft speed control derives from the embodiment shown in FIG. 5. Where the press shown in that embodiment is used to feed a pressurized heated vessel, a temperature transducer may be installed in cyclone 33. A rise in the measured temperature above a predetermined value indicates that steam is escaping from the pressure vessel back through the plug of feed material. This escape of steam is in turn an indication of insufficient consistency in the pressed material leaving the press, and can be used to generate a signal decreasing the shaft velocity to increase that consistency. If, after a lapse of time, the temperature does not decrease, logic circuitry should alert the operator, as the problem will lie elsewhere.

Other control modes may be used that do not depart from the scope of the present invention. These may be employed instead of or in addition to the modes heretofore described. They include the following—measuring the level of the feed material in tank 20 (FIG. 5) as an indication of rate of input flow and deriving from that a signal for controlling the speed of shaft 15; measuring the pressure at the output end of the press and using that, alone or in combination with a pressure measurement made at the control cross section to control the adjustment of valve 26; or measuring the pressure at the press input 23 and deriving therefrom a signal for controlling the velocity of pump 22.

It will also be appreciated that liquid expressed downstream from the control cross section in any heretofore disclosed embodiment, need not be collected in the same manner as liquid expressed upstream of that position. Since pressure control is desired only for the latter, the liquid expressed downstream from the control point may be conducted away in any convenient manner. What is important, and has been assumed throughout, is that annular compartment 6 is completely filled with liquid expressed from the mixture, and that any non-condensible gases are withdrawn at once. The removal of any gaseous components is facilitated, in the screw press embodiment, by placing opening 8 at the top of the press, as shown in the Figures.

The press of the present invention permits use of a fail-safe feature to insure against malfunction of a control system. According to this modification, at least two of the control systems heretofore described, as for example the system utilizing pressure measurement devices and the system utilizing flow volume and consistency meters, are used simultaneously, and the control signals from those two systems are compared by logic circuitry. If those signals do not agree within a predetermined range, a condition indicating a malfunction in at least one of the systems, the press is stopped.

Alternatively, if the sensors of any control system in use indicate that the sensed value of the physical property being monitored has departed from a predetermined range, the press may be stopped. Such operational control not only protects the press against failure of one or more control systems but also against failure or malfunction of any portion of the press itself.

While the embodiments discussed herein all include a control cross section located between the press inlet and outlet, it will be apparent that the location of the cross section is, within limits described above, a matter of design choice. Hence, if desired, the control cross section may be located far downstream in the press or even at the outlet itself.

Thus it will be seen that the present invention, while not difficult to implement, allows substantial improvement in press operation and control.

Figure 13:
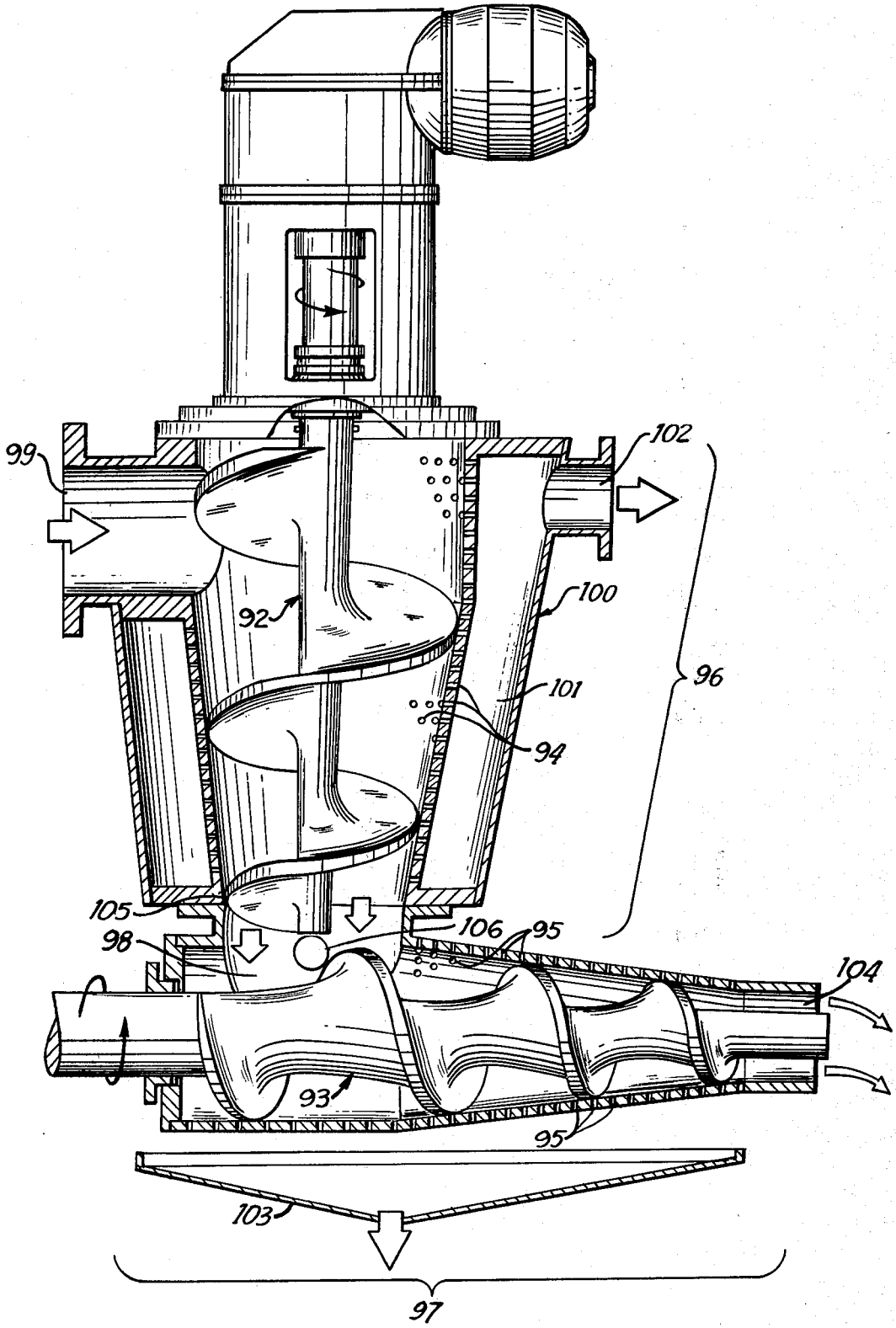
FIG. 13 is an elevational view in section of a two section press for use in practicing the invention.

Owing to this flexibility in the concept of a control cross-section, it may now be appreciated that the invention disclosed may be utilized on existing equipment by the addition of a first stabilizing press between the existing press and the delivery system feeding this existing press. The embodiment of FIG. 13 shows a two section press with screws 92 and 93, located inside stationary, perforated, conical shells 94 and 95, respectively, forming serially arranged pressing sections 96 and 97, respectively. In this embodiment section 97 may correspond to an existing press and section 96 to the additional stabilizing press. It is understood that the actual press means need not be of the screw type, and there may be more than two press sections each containing press means of a different type.

The design and operation of sections 96 and 97 are similar to that of the press mechanism of FIG. 1, where screws 92 and 93 correspond to screw 1 and shells 94 and 95 correspond to barrel 2. The outlet of section 96 is in communication with the inlet of section 97 at point 98. The material to be pressed is introduced at inlet 99. A conical shell 100 completely surrounds the perforated shell 94 of section 96, forming annular compartment 101. Compartment 101 is provided with opening 102 for the outflow of expressed liquids issuing into the compartment through the perforated shell 94. Perforated shell 95 of section 97 may or may not be surrounded by an outer shell as is shell 94 in section 96. Section 97 is shown without such an outer shell, the collection of expressed liquids issuing from the perforated shell 95 being performed in this embodiment by tray 103. After dewatering by movement through sections 96 and 97, the material exits from the press at the outlet 104.

The various control embodiments disclosed herein can be applied to the press of FIG. 13. Section 105 corresponds to the control cross-section 10 shown in FIG. 1. A pressure measuring instrument may be located at 106 as shown or further upstream along the length of the press section 96.

It may now be appreciated that this multiple section press design may achieve enhanced control potential by the independent speed control of the shafts turning screws 92 and 93 in each section. Also, drainage characteristics may be altered by the choice of different section sizes in relation to each other.

I claim:

1. A method for stabilizing the operation of a press used to separate the phases of a liquid-solid mixture wherein the discharge of liquid expressed from the mixture upstream of a control position downstream from the inlet of the press is restricted by an adjustable valve comprising the steps of (a) measuring the pressure of the liquid-solid mixture at the control position, (b) comparing the measured value of the pressure at the control position with a predetermined optimum value of the pressure at the control position, and (c) generating as a result of the comparison a change in the restriction caused by the adjustable valve which tends to reduce any difference between the measured value and the optimum value.

2. The method of claim 1 wherein the press is capable of variable speed operation and wherein a second process alteration generated as a result of the comparison is a change in the speed of the press.

3. A method for stabilizing the operation of a variable speed press used to separate the phases of a liquid-solid mixture comprising the steps of (a) determining the relationship between the pressure of the mixture at a control position downstream of the inlet of the press and the pressure of the mixture at the outlet of the press, (b) deriving from the determination an optimum value of the pressure at the control position, (c) measuring the pressure of the mixture at the control position, (d) comparing the measured value of the pressure with the predetermined optimum value of the pressure, and (e) varying the speed of the press as a result of the comparison so as to reduce any difference between the measured value and the optimum value.

4. A method for stabilizing the operation of a press used to separate the phases of a liquid-solid mixture comprising the steps of (a) measuring the values of (1) at least one physical property of the mixture being fed into the press, and (2) at least one physical property of some element of the mixture being pressed at a control position downstream from the inlet of the press, (b) computing from the measured values, according to a known formula, the value of the consistency of the mixture at the control position, (c) comparing the compound value of the consistency at the control position with a predetermined optimum control position value of the consistency, and (d) generating as a result of the comparison at least one process alteration tending to reduce any difference between the computed value and the optimum value of the consistency at the control position.

5. The method of claim 4 wherein the optimum value of consistency at the control position is that value at the control position corresponding to the preferred consistency of the pressed mixture at the output of the press.

6. The method of claim 5 wherein the control position is at the outlet end of the press.

7. The method of claim 4 wherein a physical property of the mixture being fed into the press whose value is measured is one of the flow volume per unit time and the consistency, and wherein a physical property of the mixture being pressed at the control position is the flow volume per unit time of the liquid being expressed upstream of the control position.

8. The method of claim 7 wherein the discharge of the liquid expressed from the mixture upstream of the control position is regulated by an adjustable valve and wherein a process alteration generated as a result of the comparison is a change in the restriction caused by the valve.

9. The method of claim 8 wherein the press is capable of variable-speed operation and wherein a process alteration generated as a result of the comparison is a change in the speed of the press.

10. The method of claim 8 wherein a physical property of the mixture being fed into the press whose value is measured is the level of the mixture in a feed container.

11. The method of claim 7 wherein the press is capable of variable-speed operation and wherein a process alteration generated as a result of the comparison is a change in the speed of the press.

12. The method of claim 4 wherein a physical property of the mixture being fed into the press whose value is measured is the level of the mixture in a feed container.

13. A press comprising:

an inlet at the upstream end of the press for the introduction to the press of a liquid-solid mixture from which the liquid is to be separated by pressing, an outlet for the pressed material at the downstream end of the press, a control cross section downstream from the inlet of the press, means for conducting away from the press liquid separated from the mixture upstream of the control section, adjustable means for restricting the flow of separated liquid through the conducting means, means for measuring the value of a physical property of the mixture at the control cross section, means associated with the measuring means for comparing the measured value with a predetermined optimum value at the control cross section, and means associated with the comparing means for generating as a result of the comparison a control signal capable of reducing any difference between the measured value and the predetermined optimum value.

14. The press of claim 13 wherein the control signal causes an adjustment of the flow restricting means.

15. The press of claim 14 wherein the control cross section is at the outlet.

16. The press of claim 13 wherein the measuring means comprises at least one pressure gage.

17. The press of claim 13 wherein the press is capable of variable speed operation and wherein a generated process alteration comprises a change in the speed of the press.

18. A press as described in claim 13 wherein the press is capable of variable speed operation and wherein the measured physical property of the mixture is one of the pressure and the consistency, the press further including:

logic means responsive to signals indicating (a) that the flow restricting means is adjusted to minimize the flow restriction and (b) that the measured physical property of the mixture is less than the predetermined optimum value, for causing a decrease in the speed of the press.

19. A press as described in claim 18 still further including:

second logic means responsive to signals indicating (a) that the flow restricting means is adjusted to maximize the flow restriction and (b) that the measured physical property of the mixture is greater than the predetermined optimum value, for causing an increase in the speed of the press.

20. A press as described in claim 13 wherein the press is capable of variable speed operation and wherein the measured physical property of the mixture is one of the pressure and the consistency, the press further including:

logic means responsive to signals indicating (a) that the flow restricting means is adjusted to maximize the flow restriction and (b) that the measured physical property of the mixture is greater than the predetermined optimum value, for causing an increase in the speed of the press.

21. A press for separating the phases of a liquid-solid mixture comprising:

an inlet at the upstream end of the press body for the introduction of the mixture to be separated by pressing, an outlet for the pressed material at the downstream end of the press body, a control cross section downstream from the inlet of the press, means for conducting away from the press body liquid separated from the mixture upstream of the control cross section, first means for measuring at least one physical property of the mixture being fed to the press, second means for measuring at least one physical property of the liquid in the conducting means, control means associated with the first and second measuring means for generating as a result of the measurements an indication of the actual consistency of the mixture at the control cross section, for comparing that indication with a predetermined optimum value at the control cross section, and for generating as a result of the comparison a control signal capable of reducing any difference between the actual value of the consistency and the predetermined optimum value.

22. The press of claim 21 wherein the first and second measuring means are separate from the press body.

23. The press of claim 22 wherein the liquid conducting means includes an adjustable means for restricting the flow of liquid therethrough and wherein the control signal adjusts the flow restriction to thereby reduce any difference between the actual value of the consistency and the predetermined optimum value.

24. The press of claim 23 further comprising a feed container and wherein the first measuring means measures the level of the mixture in the feed container.

25. A press as described in claim 21 wherein the press is of the disk type.

26. The disk press of claim 25 further comprising:

two perforated rotatable disks, each having on its rear surface a plurality of closed compartments in which collects liquid separated from the mixture by pressing, each disk being rigidly connected on its rear surface to a cylindrical hub, each compartment being connected to the perimeter of the hub by a conduit, a stationary annular ring surrounding each hub and having a plurality of internal chambers leading to outlet pipes and connected to the inner perimeter of the ring such that, as the disk and hub rotate with respect to the ring, successive conduits come into communication with the internal chambers, wherein the means for conducting away from the press body liquid separated from the mixture upstream of the control cross section is the internal chamber with which each conduit first comes into communication as the disk and hub rotate.

27. The press of claim 21 further comprising a feed container and wherein the first measuring means measures the level of the mixture in the feed container.

28. The press of claim 21 wherein the control cross section is at the outlet.

29. A press comprising:

an inlet at the upstream end of the press for the introduction to the press of a liquid-solid mixture from which the liquid is to be separated by pressing;

an outlet for the pressed material at the downstream end of the press;

means for conducting away from the press liquid separated from the mixture over at least a portion of the length of the press;

adjustable means for restricting the flow of separated liquid through the conducting means;

measuring means located at a preselected point upstream of the outlet for measuring the value of a physical property of the mixture at the preselected point;

means associated with the measuring means for comparing the measured value with a predetermined optimum value for the preselected point where the measurement is taken; and means associated with the comparing means for generating as a result of the comparison a control signal capable of reducing any difference between the measured value and the predetermined optimum value.

30. The press of claim 29 wherein the control signal causes an adjustment of the flow restricting means.

31. The press of claim 29 or 30 wherein the measuring means comprises at least one strain gauge.

32. A press for separating the phases of a liquid-solid mixture comprising:

an inlet at the upstream end of the press for the introduction of the mixture to be separated by pressing;

an outlet for the pressed material at the downstream end of the press;

means for conducting away from the press liquid separated from the mixture over at least a portion of the length of the press;

first means for measuring at least one physical property of the mixture being fed to the press;

second means for measuring at least one physical property of the liquid in the conducting means; and control means associated with the first and second measuring means for generating as a result of the measurements an indication of the actual consistency of the mixture as it passes a position corresponding to the downstream end of that portion of the length of the press associated with the conducting means, for comparing that indication with a predetermined optimum value for this same position, and for generating as a result of the comparison a control signal capable of reducing any difference between the actual value of the consistency and the predetermined optimum value.

33. The press of claim 29 or 32 wherein the press is capable of variable speed operation and wherein the control signal causes a change in the speed of the press.

34. The press of claim 29 or 32 wherein the press is comprised of at least two sections serially arranged, each chamber including a means for pressing the liquid-solid mixture.

35. The press of claim 34 wherein each press means is independently capable of variable speed operation and wherein the control signal causes a change in the speed of at least one of the pressing means.

36. The press of claim 32 wherein at least one of the first and second measuring means is separate from the press.

37. The press of claim 32 wherein the liquid conducting means includes an adjustable means for restricting the flow of liquid therethrough and wherein the control signal adjusts the flow restricting means.

38. The press of claim 30 or 37 wherein the press is capable of variable speed operation and wherein the measured physical property of the mixture is one of the pressure and the consistency, the press further including:

logic means responsive to signals indicating (a) that the flow restricting means is adjusted to maximize the flow restriction and (b) that the measured physical property of the mixture is greater than the predetermined optimum value, for causing an increase in the speed of the press.

39. The press of claim 32 or 37 further comprising a feed container and wherein the first measuring means measures the level of the mixture in the feed container.

40. The press of claim 21 or 32 wherein the first measuring means measures one of the flow volume per unit time and the consistency of the mixture being fed to the press.

* * * * *

UNITED STATES PATENT AND TRADEMARK OFFICE

CERTIFICATE OF CORRECTION

PATENT NO. : 4,273,035

DATED : June 16, 1981

INVENTOR(S) : Dante S. Cusi

It is certified that error appears in the above-identified patent and that said Letters Patent are hereby corrected as shown below:

Col. 12, line 33, "compound" should be --computed--.

Signed and Sealed this

*Twentieth* Day of *April 1982*

[SEAL]

*Attest:*

GERALD J. MOSSINGHOFF

*Attesting Officer*

*Commissioner of Patents and Trademarks*